US009476371B2

(12) United States Patent
Hassdenteufel et al.

(10) Patent No.: US 9,476,371 B2
(45) Date of Patent: Oct. 25, 2016

(54) METHOD FOR DETERMINING A FILLING DIFFERENCE IN CYLINDERS OF AN INTERNAL COMBUSTION ENGINE, OPERATING METHOD, AND CALCULATION UNIT

(71) Applicant: Robert Bosch GmbH, Stuttgart (DE)

(72) Inventors: Armin Hassdenteufel, Sachsenheim-Ochsenbach (DE); Guido Porten, Vaihingen/Enz (DE); Andreas Roth, Muehlacker-Lomersheim (DE); Uwe Mueller, Cleebronn (DE)

(73) Assignee: Robert Bosch GmbH, Stuttgart (DE)

( * ) Notice: Subject to any disclaimer, the term of this patent is extended or adjusted under 35 U.S.C. 154(b) by 739 days.

(21) Appl. No.: 13/670,668

(22) Filed: Nov. 7, 2012

(65) Prior Publication Data

US 2013/0124069 A1 May 16, 2013

(30) Foreign Application Priority Data

Nov. 10, 2011 (DE) ..... 10 2011 086 064

(51) Int. Cl.

| | |
|---|---|
| ***F02D 41/26*** | (2006.01) |
| ***F02D 41/30*** | (2006.01) |
| ***F02D 41/00*** | (2006.01) |
| ***F02D 41/14*** | (2006.01) |
| *F02D 41/18* | (2006.01) |

(52) U.S. Cl.

CPC ..... *F02D 41/00* (2013.01); *F02D 41/008* (2013.01); *F02D 41/0085* (2013.01); *F02D 41/1497* (2013.01); *F02D 41/18* (2013.01)

(58) Field of Classification Search

CPC ..... F02D 41/04; F02D 33/00; F02D 41/00; F02D 41/40; F02D 43/02

USPC ..... 701/103, 104, 110, 111, 112; 73/114.11, 114.13, 114.15, 114.16, 73/114.17, 114.22, 114.25

See application file for complete search history.

(56) References Cited

U.S. PATENT DOCUMENTS

| | | | | |
|---|---|---|---|---|
| 8,620,564 | B2 * | 12/2013 | Hakariya et al. | 701/104 |
| 2003/0216853 | A1 * | 11/2003 | Jacobson | 701/106 |
| 2007/0245818 | A1 * | 10/2007 | Matekunas et al. | 73/118.1 |
| 2008/0040018 | A1 * | 2/2008 | Katoch | F02D 13/0215 701/103 |
| 2010/0286892 | A1 * | 11/2010 | Aliakbarzadeh | 701/103 |

FOREIGN PATENT DOCUMENTS

DE 10 2008 054 690 6/2010

* cited by examiner

*Primary Examiner* — Hai Huynh
*Assistant Examiner* — Raza Najmuddin
(74) *Attorney, Agent, or Firm* — Norton Rose Fulbright US LLP

(57) ABSTRACT

In a method for determining a filling difference between at least two cylinders of an internal combustion engine, e.g., an Otto-cycle engine, a power output parameter contribution made available by the respective cylinder to a total power output parameter of the internal combustion engine is ascertained for each of the at least two cylinders for different fuel quantities, and an air inhomogeneity between the at least two cylinders is ascertained on the basis of the power output parameter contributions, ascertained for the different fuel quantities, of the at least two cylinders.

10 Claims, 4 Drawing Sheets

METHOD FOR DETERMINING A FILLING DIFFERENCE IN CYLINDERS OF AN INTERNAL COMBUSTION ENGINE, OPERATING METHOD, AND CALCULATION UNIT

BACKGROUND OF THE INVENTION

1. Field of the Invention

The present invention relates to a device and a method for determining a filling difference in cylinders of an internal combustion engine having at least two cylinders.

2. Description of the Related Art

The air/fuel ratio in Otto-cycle engines is usually set in such a way that the average of the lambda values of all cylinders (so-called "total lambda") $\lambda$ is equal to 1.0. This makes possible low-emissions operation, since catalytic converters exhibit their best effectiveness with stoichiometric combustion.

As a result of metering tolerances and air/filling differences between individual cylinders, e.g. as a result of system tolerances, the lambda values in the individual cylinders of an internal combustion engine can deviate from one another despite identical control application. The total lambda measured in the exhaust, which total is made up of the contributions of the respective individual cylinders, can therefore assume the target value $\lambda=1.0$ even though the lambda values of the individual cylinders fluctuate around that average. A corresponding deviation of individual cylinders from the average is also referred to as a "cylinder inhomogeneity."

A cylinder inhomogeneity has a number of disadvantages. A shift in the individual-cylinder lambda values firstly results directly in an increase in fuel consumption. If a specific threshold is exceeded, emissions become worse. The so-called "stringiness" of the exhaust gas, i.e. the formation of flow strands in the exhaust mass flow as a result of, for example, filling differences, additionally plays a role here.

At a constant air/fuel ratio the power parameters of an engine, more precisely of a cylinder, are proportional to the mass of air or mixture delivered to the cylinder, i.e. to the volumetric efficiency. The indices that serve to define the volumetric efficiency are, as generally known, the delivery ratio and the charging efficiency. If the volumetric efficiency values of the cylinders deviate from one another, their torque contributions—i.e. the respective cylinders' shares of the total torque—also differ. This causes irregularities in engine speed.

When "power output parameters" or more generally "power output" is discussed in the context of this invention, this term is not to be understood as being limited to a power output in the sense of a physical variable. The terms instead also encompass, for example, a torque as well as an indicated and/or effective mean pressure of a cylinder. Such indices are linked via conversions to one another and to the power output of a cylinder, and define it.

Reliable methods for recognizing filling differences are not yet available for Otto-cycle engines, and for that reason a corresponding need exists.

BRIEF SUMMARY OF THE INVENTION

According to the present invention, a method for determining a filling difference in cylinders of an internal combustion engine having at least two cylinders, an operating method based thereon, and a calculation unit for carrying it out are proposed.

At a constant air/fuel ratio the power output parameters (understood in the above sense) of a cylinder are, as mentioned, proportional to the mass of air or mixture delivered to the cylinder, i.e. to the volumetric efficiency. Conversely, if the fuel/air ratio is modified for a constant volumetric efficiency, the power output parameters change. The present invention makes use of this fact, and makes possible a statement as to the volumetric efficiencies of cylinders on the basis of the fuel mass delivered to the cylinders, in the context of an air mass that is initially assumed to be constant.

The power output parameters (for example, as mentioned, the torque, indicated mean pressure, and/or effective mean pressure) of a cylinder or an engine reach a maximum, for usual Otto-cycle fuels, at a lambda value of approx. $\lambda=0.95$. If a volumetric efficiency value of a cylinder, or the air mass introduced into the cylinder, is not known, it is therefore possible, by modifying the quantity of fuel introduced into the cylinder, to determine that quantity of fuel at which the actual lambda value in the cylinder $\lambda=0.95$ by ascertaining the power output parameter contribution of the respective cylinder. When the value of the power output parameter contribution is maximal, the actual lambda value in the cylinder is $\lambda=0.95$. This is carried out for all cylinders. The filling inhomogeneity can then be inferred from the locations of the maxima with respect to one another.

The power output parameter contribution can be determined by way of a method that evaluates a signal of an internal combustion engine that correlates with the power output parameter (i.e. the torque, power output, indirect mean pressure and/or effective mean pressure) introduced by the respective cylinder. This advantageously involves a physical feature based on the rotation speed signal, e.g. in the form of so-called "tooth times." A corresponding method is disclosed, for example, in published German patent application document DE 10 2008 054 690 A1, in which an encoder wheel, e.g. a gear wheel, coupled to a crankshaft of an internal combustion engine is monitored by at least one sensor, as explained in further detail below in conjunction with FIG. 2. A corresponding encoder wheel has markings (e.g. teeth) distributed over its periphery. By "counting" these markings and by corresponding time-based evaluation, it is possible to determine the times within which corresponding markings of the encoder wheel pass by a rotation speed sensor. Individual-cylinder power level parameter contributions can be inferred on the basis of the times. For example, if an individual cylinder is contributing an above-average torque to the total torque, this is expressed as a brief acceleration of the rotation speed during the power stroke of that cylinder; conversely, a below-average power output parameter contribution leads to a decrease in rotation speed during the power stroke of that cylinder. Reference is made to the aforesaid published German patent application document DE 10 2008 054 690 A1 for further details.

A corresponding power output parameter contribution is advantageously ascertained, as mentioned, for different fuel quantities. This is accomplished usefully in the context of consideration of an individual cylinder. A respectively considered cylinder is referred to hereinafter as a "measured cylinder."

The power output parameter contribution of a corresponding measured cylinder can be considered at different individual target lambda values. In corresponding internal combustion engines the air mass delivered to each of the cylinders is usually not modified, so that the target lambda values are set by setting the fuel quantity, or correspond to such a quantity.

A prerequisite for informative measurements is that there be only a slight change in the rotation speed and load over an evaluation time span. The injection valves should be equalized in terms of their flow rate; otherwise the difference cannot be attributed to fuel or air. If each valve is supplying identical quantities of fuel, the difference in location of the maxima can result only from different quantities of air. A catalyst that is used should be in its conversion range, since otherwise the method can result in an increase in emissions. The engine should be warmed to operating temperature, since otherwise so-called wall film deposits influence the measurement result, and emissions are higher.

The method proposed according to the present invention usefully encompasses a series of steps. Firstly the measured cylinder is set to a target lambda value by specifying a so-called delta fuel mass (i.e. a deviation from the global fuel mass that is the same for all cylinders). The remaining cylinders can then be set so that the total lambda of the internal combustion engine assumes the value $\lambda=1$, in order to minimize the influence of the method on emissions. The power output parameter contribution for the instantaneous fuel mass (also referred to as "relative" fuel mass) of the measured cylinder can now be ascertained.

In certain engine control systems, the volumetric efficiency is represented as a relative air filling value referred to standard conditions. For a global $\lambda=1$, e.g. at a 30% relative air filling value, a relative fuel filling value of 30% is then required. Relative air filling values greater than 100% are possible with turbocharged engines. Such concepts are also intended to be encompassed by the present invention.

The determination can occur in the context of multiple parallel measurements, the number of which can be specified in order to minimize interference effects. Corresponding values can be stored. The steps recited above are then repeated for different target lambda values (and thus different relative fuel masses), for example in a range from $\lambda=0.9$ to $\lambda=1.20$, in a selectable pattern. Another cylinder is then selected as the measured cylinder. Once all the cylinders have been correspondingly surveyed, the method according to the present invention is complete and the results can be evaluated. As explained, the maximum of the power output parameter contribution is located at approximately $\lambda=0.95$, so that the relative fuel mass for $\lambda=0.95$ for each cylinder can be determined from the dependence of the power output parameter contribution on the relative fuel mass. The filling distribution of the individual cylinders can be inferred from the locations of the maxima of the individual cylinders. In addition to the detection of filling differences, it is possible to ascertain for each cylinder a fuel correction that can be employed in the future for injection. An equalization of the individual-cylinder lambda is thus accomplished.

Because of the prerequisite that the valves be equalized at full stroke, deviations in the different locations of the maxima of the power output parameter contributions in the various cylinders can be caused only by an air inhomogeneity of the cylinders with respect to one another.

In the case of a cylinder in which the maximum is located at a higher relative fuel quantity, more fuel is thus being injected in order to reach a maximum power output parameter. This means that more air must have been present. Conversely, a maximum at a lower relative fuel contribution means that less air is present in a corresponding cylinder.

Proceeding from the determination according to the present invention of the difference in filling, it is possible to implement applications that could not be carried out, or could be carried out only under difficult conditions in the existing art, because of the absence of a corresponding determination capability. This offers numerous advantages.

The lambda values of individual cylinders, the cylinder filling, and the fuel quantity injected by the respective injection valves can, in this context, be adjusted to one another and/or an air inhomogeneity can be diagnosed.

Equalization of the individual-cylinder lambda values, i.e. a balance between the individual cylinders, is advantageous for reducing emissions. In the context of the invention, the relative fuel mass for $\lambda=0.95$ can be ascertained for each cylinder. It is thus possible to adjust the relative fuel masses so as to yield $\lambda=1$ for each cylinder. This results in great advantages especially in the context of a cold start of an Otto-cycle engine, since emissions occur here that should be limited if possible. What typically occurs with an Otto-cycle engine at the beginning of the cold start is a catalytic converter heating phase (so-called "cold heating") during which the three-way catalytic converter that is present is heated to its conversion temperature. All the raw emissions emitted during this time period are discharged to the environment and thus contribute to a considerable proportion of the total exhaust behavior of the vehicle. Fuel metering during this period usually occurs on the basis of a pilot control system. Only when the lambda probe is supplying a valid signal is the pilot control system replaced by a closed-loop control system. The pilot control system and the closed-loop control system always refer to the values of all the cylinders, and thus act only globally. The goal here is to generate the lowest possible raw emissions until the catalytic converter is converting. A fresh-air inhomogeneity can, however, result in different actual lambda values in the cylinders, which lead to inhomogeneous and non-optimal raw emissions. The method according to the present invention can advantageously be used here by utilizing the ascertained values (e.g. for fuel correction) in the context of a corresponding pilot control system. The information regarding the air inhomogeneity can be utilized in this context for adaptation of the individual-cylinder fuel masses. A target lambda that reduces raw emissions during cold heating can be established for each individual cylinder.

In a system that has the capability of setting filling (via an adjustment of air mass) for an individual cylinder, the information can be used to equalize filling across the cylinders. A diagnosis of air inhomogeneity and an equalization of the injection valves can likewise be implemented with the available information.

A method according to the present invention for operating an internal combustion engine profits from the explained advantages. The same is true of a control device or calculation unit (e.g. a control device of a motor vehicle) that is directed, especially in terms of program technology, toward carrying out the method according to the present invention.

Implementation of the method in the form of software is also advantageous, since this generates particularly low costs, in particular if an executing control device is also used for further tasks and is therefore present in any case. Suitable data media for making the computer program available are, in particular, diskettes, hard drives, flash memories, EEPROMs, CD-ROMs, DVDs, and others. Downloading of a program via computer networks (internet, intranet, etc.) is also possible.

Further advantages and embodiments of the invention are evident from the description and the appended drawings.

It is understood that the features recited above and those yet to be explained below are usable not only in the respective combination indicated, but also in other combinations or in isolation, without departing from the scope of the present invention.

DETAILED DESCRIPTION OF THE INVENTION

Figure 1:
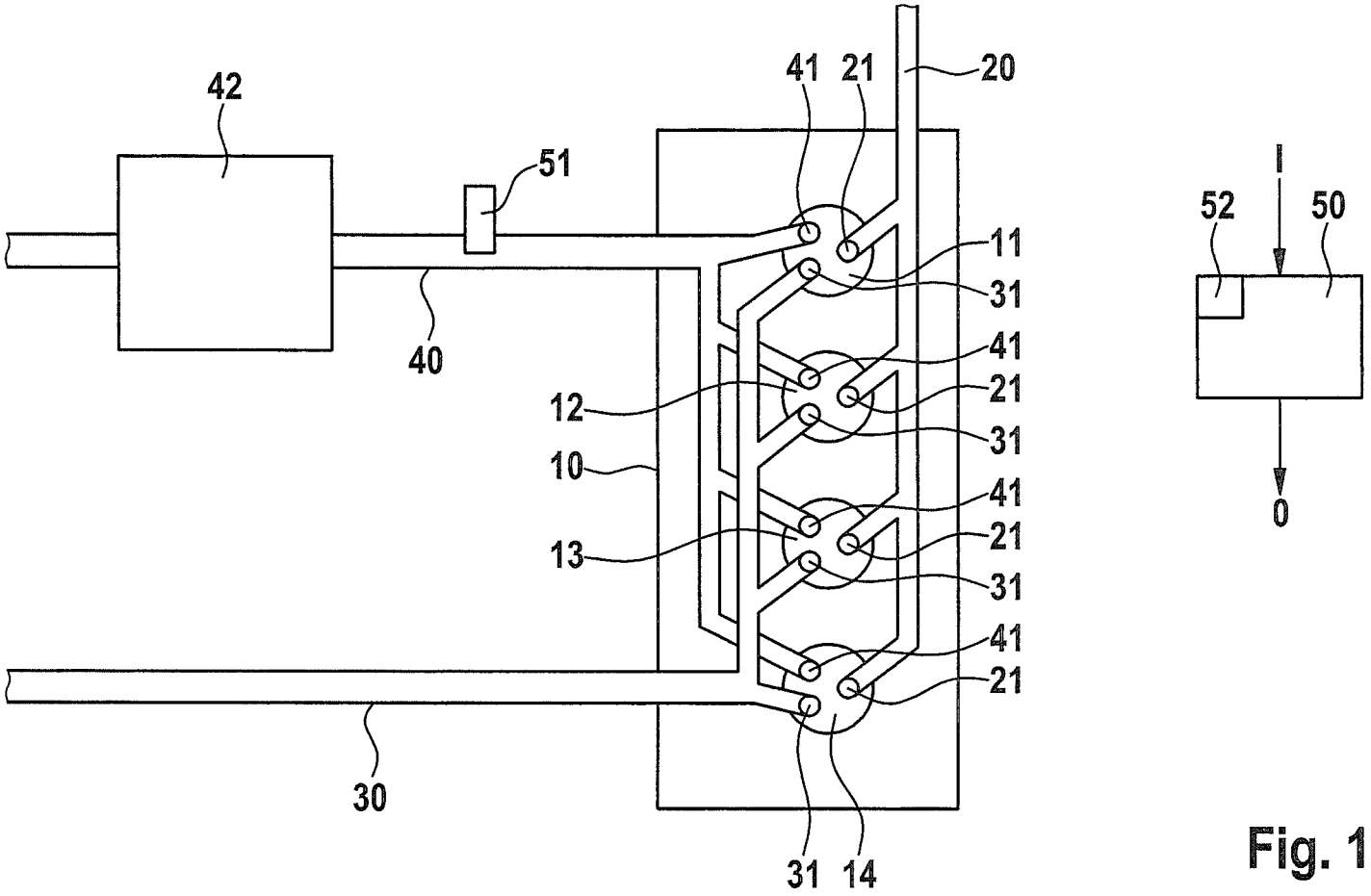
FIG. 1 is a schematic plan view of an internal combustion engine in which aspects according to the present invention can be realized.

FIG. 1 is a schematic plan view of a portion of a motor vehicle having an internal combustion engine 10 having a fuel system 20, intake air system 30, and exhaust system 40, as well as a calculation unit 50 as a control device for controlling it. Internal combustion engine 10 is embodied preferably as an Otto-cycle engine with direct fuel injection. In the exemplifying embodiment depicted, internal combustion engine 10 encompasses four cylinders 11, 12, 13, 14, but any other number of cylinders is also possible. Fuel is made available by fuel system 20 and is injected via individually controllable injection valves 21 into the respective cylinders 11, 12, 13, 14.

Air is delivered via intake air system 30 to cylinders 11, 12, 13, 14, an inlet valve 31 being provided for each of cylinders 11, 12, 13, 14. A throttle valve that is usually provided to adjust the quantity of air is not depicted. Combustion exhaust gas is expelled from cylinders 11, 12, 13, 14 via exhaust valves 41 and discharged via exhaust system 40. A catalytic converter 42, which among other things converts carbon monoxide and nitrogen oxides and is advantageously embodied as a three-way catalytic converter, is provided in exhaust system 40. A lambda probe 51 is disposed in exhaust system 40 upstream from catalytic converter 42.

Control device 50 is in effective connection with actuating members of internal combustion engine 10, of fuel system 20, of intake air system 30, and/or of exhaust system 40, in order to apply control to them in suitable fashion. In detail, control device 50 applies control to, for example, injection valves 21, intake valves 31, exhaust valves 41, and further actuating members (such as e.g. the throttle valve). Control device 50 is, in particular, embodied to specify a defined fuel quantity by way of injection valves 21. Control device 50 can have a lambda controller 52 embodied as part of control device 50. Control device 50 is set up in terms of program technology to carry out a method according to the present invention.

Also provided besides lambda probe 51 are further sensors (not shown), such as e.g. temperature sensors and/or pressure sensors, in order to sense corresponding engine states so that the operation of internal combustion engine 10 can be implemented as a function thereof by way of control device 50. Lambda probe 51 is set up to sense an oxygen content in exhaust system 40, and transmits that value, or a corresponding one derived therefrom, for example to lambda controller 52 implemented in control device 50.

Control device 50 controls the internal combustion engine by way of control application instructions O, or by transmitting corresponding parameters in order to make a drive torque available. For this, control device 50 receives inputs I (for example, external requests such as a driver torque request, an accelerator pedal position, and the like), with which a drive torque request can be specified from outside. Control device 50 further receives from the aforesaid sensors, as inputs I, corresponding information about engine states, for example a rotation speed, pressures and temperatures in air delivery system 20 and/or in exhaust system 40.

In normal operation, all cylinders 11, 12, 13, 14 of internal combustion engine 10 are active and are fired, for example, in a predefined sequence in accordance with a sufficiently known four-stroke mode not further explained here.

Figure 2:
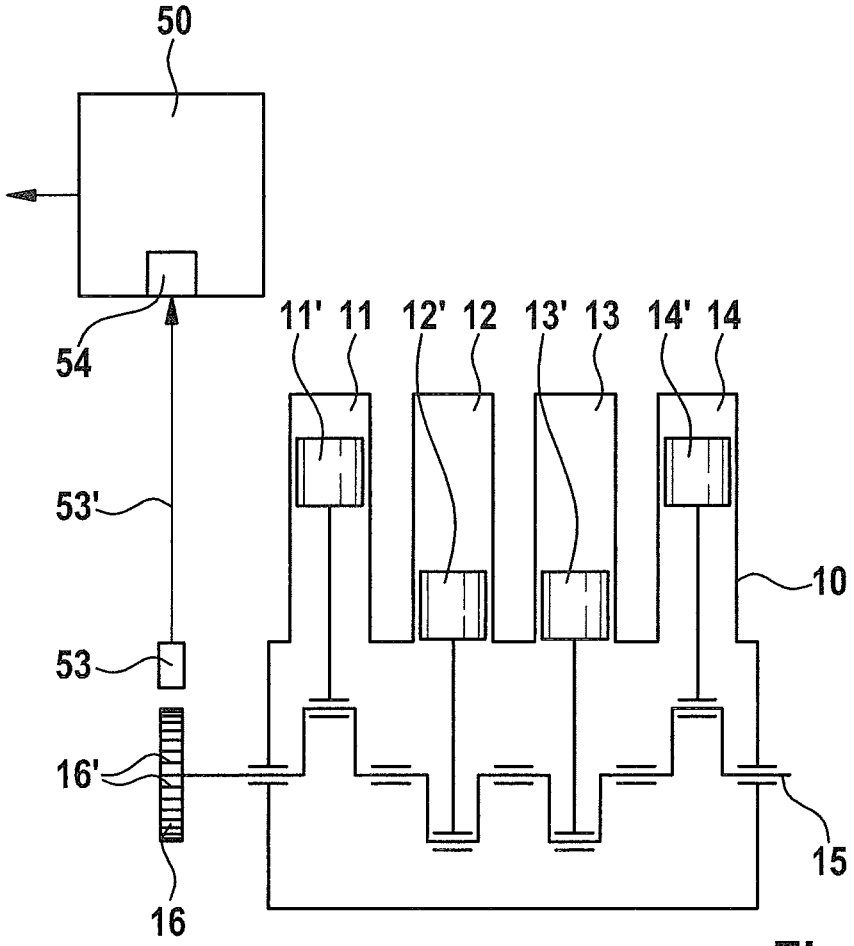
FIG. 2 is a schematic side view of an internal combustion engine in which aspects according to the present invention can be realized.

FIG. 2 is a side view showing an alternative depiction of the portion in FIG. 1; for clarity, elements identical to those in FIG. 1 are not explained again. Depiction of a number of components, in particular of fuel system 20, of intake air system 30, and of exhaust system 40, has been omitted here.

Respective pistons 11', 12', 13', 14' are disposed in cylinders 11, 12, 13, 14. The gas forces acting on pistons 11', 12', 13', 14' when the corresponding cylinder 11, 12, 13, 14 fires are transferred, via piston rods 11", 12", 13", 14" associated therewith, to a crankshaft 15. In the context of a cylinder inhomogeneity previously explained, e.g. if the cylinder filling is different, the gas forces acting on pistons 11', 12', 13', 14' vary, as also does the uniformity of the rotational motion of crankshaft 15.

An encoder wheel 16 is nonrotatably coupled here to crankshaft 15 in order to determine the power output parameter contributions of individual cylinders 11, 12, 13, 14. The rotational motion of encoder wheel 16 is reflected, for example, in a signal 53' of a rotation angle sensor 53. Control device 50, or a correspondingly provided evaluation module 54, evaluates signal 53' and determines individual-cylinder values therefrom.

Encoder wheel 16, which is visible in a side view in FIG. 2, has markings 16' distributed over its periphery. These markings 16' can be, for example, ferromagnetic projections whose edges, as they pass by an inductive sensor used as rotation speed sensor 53, generate steep edges in signal 53'. Markings 16' can also be teeth of a gear wheel, so that so-called "tooth times" are thus ascertained. By counting the signal edges, control device 50 identifies the respective beginning and end of a corresponding marking and determines times within which they move past rotation speed sensor 53.

On the basis of the segment times, it is possible to draw inferences as to individual-cylinder power output parameter contributions M, i.e. contributions of a respectively fired cylinder 11, 12, 13, 14 to a total power output parameter of internal combustion engine 10, e.g. in the form of individual torques. As already explained, for example, the torque of a cylinder 11, 12, 13, 14 is greatest when a mixture having a specific lambda value is combusted in it. For usual Otto-cycle fuels this specific lambda value is equal to approx. 0.95; a slightly rich mixture is therefore present, i.e. a slight excess of fuel with respect to the oxygen that is present.

If a power output parameter contribution M of a cylinder 11, 12, 13, 14 is therefore ascertained at different target lambda values (i.e. different quantities of fuel for an oxygen proportion that is assumed to be constant), it is possible to infer, from the maximum power output parameter contribution, the actual fuel/air ratios present in cylinder 11, 12, 13, 14. For this, a maximum value is ascertained (by selecting a corresponding individual value or by interpolation or extrapolation using a suitable function) on the basis of the different power output parameter contributions at the target lambda values. The maximum power output parameter contribution corresponds to the target lambda value at which the actual lambda value is $\lambda=0.95$. Based on a knowledge of this actual lambda value and the quantity of fuel actually introduced for that value, and the locations of the maxima of the individual cylinders, it is possible to infer the filling distribution of the individual cylinders.

Figure 3:
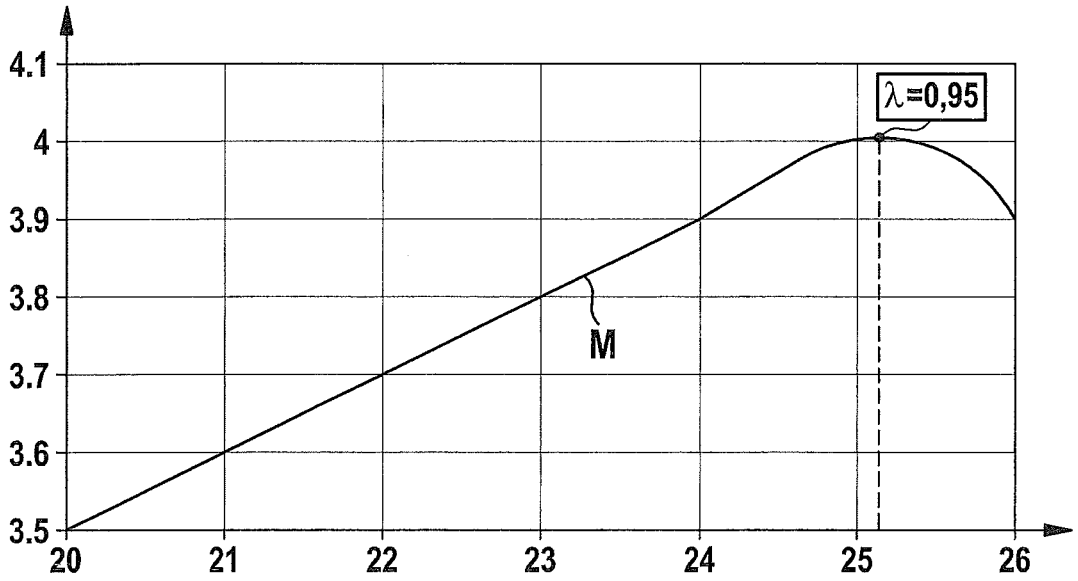
FIG. 3 is a diagram to illustrate a relationship between a power output parameter contribution and a fuel mass.

FIG. 3 illustrates in the form of a diagram in which a power output parameter contribution M is plotted on the ordinate in corresponding units (e.g. W, Nm, or bar, depending on the physical variable) against a relative fuel mass (in %) on the abscissa.

Because a maximum power output parameter contribution (at approx. 4 units in the illustration) is known to occur at an actual lambda value $\lambda=0.95$, the relative fuel mass at which this actual lambda value exists, in this case at approximately 25.2%, can be inferred from the diagram of FIG. 3. The filling distribution of the individual cylinders can be inferred from the locations of the maxima of the individual cylinders.

Figure 4:
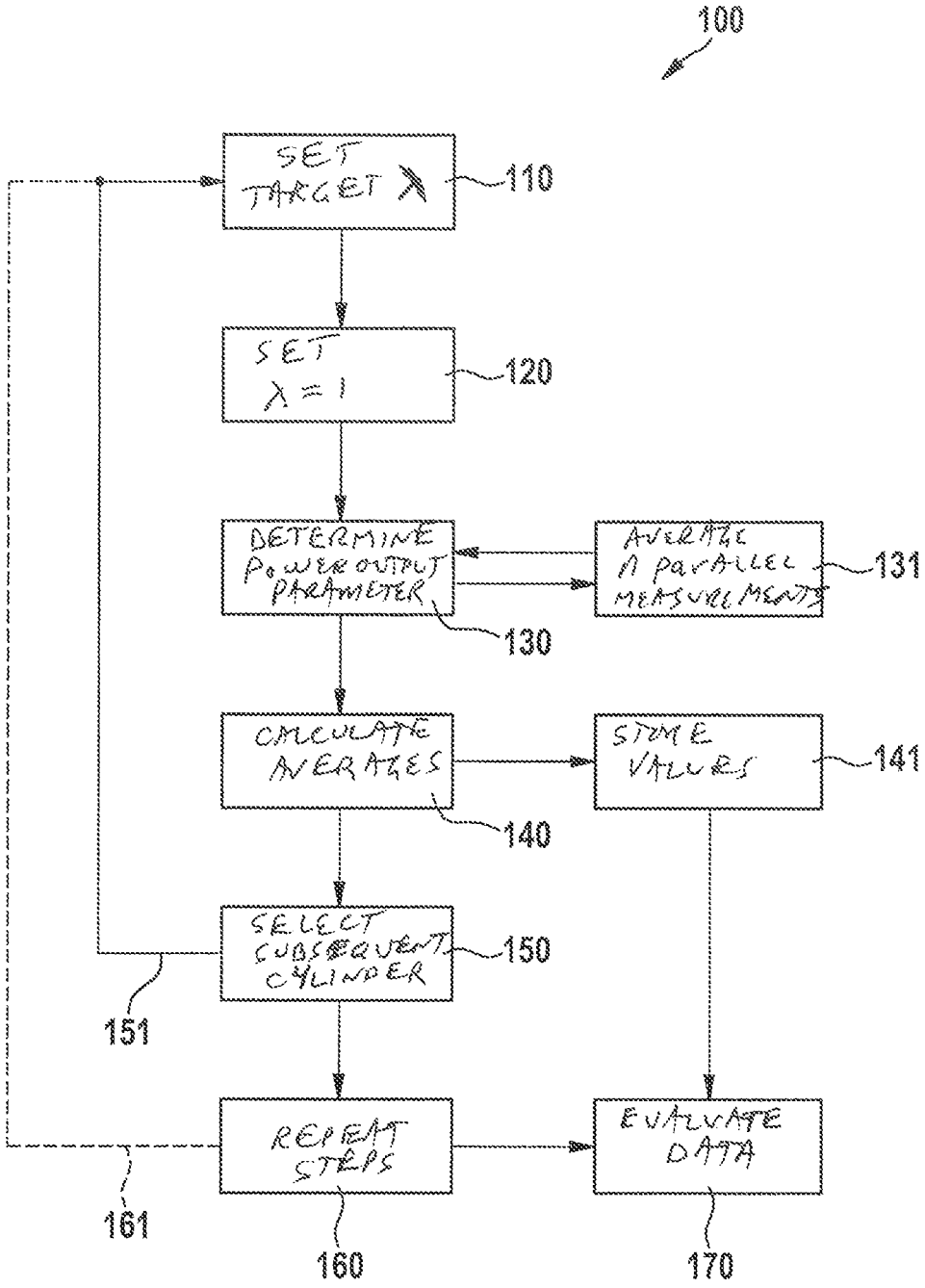
FIG. 4 schematically depicts a method in which aspects according to the present invention can be realized.

FIG. 4 schematically depicts a method, labeled 100 in its entirety, according to a particularly preferred embodiment of the invention.

In a first step 110 the particular measured cylinder being considered is set to a target lambda value.

In a second step 120 the remaining cylinders are set so that the total lambda of the internal combustion engine, i.e. the mixture ratio combusted in all the cylinders, assumes a value of 1, in order to minimize the influence of the method on emissions.

In a third step 130 a power output parameter contribution of the measured cylinder for the instantaneous relative fuel mass is determined. This can occur in the context of an average of n parallel measurements that can be specified correspondingly so as to minimize interference. The latter is illustrated with step 131.

In a fourth step 140 averages are calculated for the n parallel measurements of the torque contributions ascertained in the third step 130. Corresponding values can be stored, as illustrated with step 141.

The steps 110 to 140 explained above are repeated in a fifth step 150 for different lambda values, for example for target lambda values from $\lambda=0.9$ to $\lambda=1.20$, in a selectable pattern, i.e. at different measurement points. This is illustrated by arrow 151.

In a sixth step 150 a subsequent cylinder is selected as a measured cylinder to be considered. The aforesaid steps 110 to 150 are correspondingly repeated for this cylinder, as illustrated by arrow 161. Once all the cylinders have been measured, the method according to the present invention is complete in terms of measurement.

In step 170 an evaluation of the data respectively stored in step 141 can then occur, in particular by determining for each cylinder the relative fuel mass for the power output parameter contribution maximum, and from that the associated air quantity.

What is claimed is:

1. A method for determining and equalizing a filling difference between at least two cylinders of an internal combustion engine configured as an Otto-cycle engine, comprising:

ascertaining a power output parameter contribution made available by each cylinder to a total power output parameter of the internal combustion engine for different fuel quantities;

ascertaining an air inhomogeneity between the at least two cylinders based on the ascertained power output parameter contributions of the at least two cylinders for the different fuel quantities;

determining a filling difference for the at least two cylinders of the internal combustion engine; and equalizing at least one of lambda values, air volumes, and injection quantities of the at least two cylinders with one another based on the filling difference;

wherein a maximum of a power output parameter contribution has a particular lambda value, so that a relative fuel mass for the particular lambda value for each of the cylinders is determinable from a dependence of the power output parameter contribution on the relative fuel mass, and wherein a filling distribution of the cylinders is inferred from locations of each maximum of the individual cylinders.

2. The method as recited in claim 1, wherein the different fuel quantities are specified in the form of different target lambda values.

3. The method as recited in claim 1, wherein the power output parameter contributions are ascertained by evaluating a rotation speed signal dependent on a rotation speed of the internal combustion engine.

4. The method as recited in claim 3, wherein the rotation speed signal dependent on the rotation speed of the internal combustion engine is ascertained by using an encoder wheel coupled to the crankshaft of the internal combustion engine.

5. The method as recited in claim 2, wherein a total lambda value of the internal combustion engine is regulated to a fixed value of $\lambda=1$.

6. The method as recited in claim 2, wherein an injected fuel quantity at which the cylinder supplies the greatest power output parameter contribution is ascertained for each of the at least two cylinders.

7. The method as recited in claim 1, wherein the power output parameter contribution for each of the at least two cylinders is ascertained in each case by averaging multiple parallel measurements.

8. The method as recited in claim 1, wherein a filling difference is determined for all fired cylinders of the internal combustion engine.

9. A control device for determining and equalizing a filling difference between at least two cylinders of an internal combustion engine configured as an Otto-cycle engine, comprising:

a first ascertaining arrangement to ascertain a power output parameter contribution made available by each cylinder to a total power output parameter of the internal combustion engine for different fuel quantities; and a second ascertaining arrangement to ascertain an air inhomogeneity between the at least two cylinders on the basis of the ascertained power output parameter contributions of the at least two cylinders for the different fuel quantities;

a determining arrangement to determine a filling difference for the at least two cylinders of the internal combustion engine; and an equalizing arrangement to equalize at least one of lambda values, air volumes, and injection quantities of the at least two cylinders with one another based on the filling difference;

wherein a maximum of a power output parameter contribution has a particular lambda value, so that a relative fuel mass for the particular lambda value for each of the cylinders is determinable from a dependence of the power output parameter contribution on the relative fuel mass, and wherein a filling distribution of the cylinders is inferred from locations of each maximum of the individual cylinders.

10. The control device as recited in claim 9, further comprising:

a modifying arrangement to modify a fuel quantity respectively injected into the at least two cylinders; and a third ascertaining arrangement to ascertain an air quantity respectively introduced into the at least two cylinders based on the power output parameter contributions ascertained at different fuel quantities.

* * * * *